US007600609B2

(12) United States Patent
Nakamura

(10) Patent No.: US 7,600,609 B2
(45) Date of Patent: Oct. 13, 2009

(54) SOUND-ABSORBING PANEL AND PRODUCTION METHOD OF THE SAME

(75) Inventor: Yasutaka Nakamura, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 23 days.

(21) Appl. No.: 11/730,050

(22) Filed: Mar. 29, 2007

(65) Prior Publication Data

US 2007/0227815 A1 Oct. 4, 2007

(30) Foreign Application Priority Data

Mar. 31, 2006 (JP) ..... P 2006-097002
Jan. 9, 2007 (JP) ..... P 2007-001186

(51) Int. Cl.

| | |
|---|---|
| ***E04B 1/82*** | (2006.01) |
| ***E04B 2/02*** | (2006.01) |
| ***E04B 2/14*** | (2006.01) |
| *E04B 1/74* | (2006.01) |
| *E04B 1/62* | (2006.01) |

(52) U.S. Cl. ..... 181/290; 181/292; 181/286

(58) Field of Classification Search ..... 181/290, 181/292, 286, 293

See application file for complete search history.

(56) References Cited

U.S. PATENT DOCUMENTS 4,235,303 A * 11/1980 Dhoore et al. ..... 181/214
5,820,975 A * 10/1998 Oda et al. ..... 428/219
6,182,787 B1 * 2/2001 Kraft et al. ..... 181/292
6,345,688 B1 * 2/2002 Veen et al. ..... 181/290
6,609,592 B2 * 8/2003 Wilson ..... 181/292
2006/0124387 A1 * 6/2006 Berbner et al. ..... 181/290
2007/0272483 A1 * 11/2007 Morin et al. ..... 181/292

FOREIGN PATENT DOCUMENTS

| | | | |
|---|---|---|---|
| JP | 6-348281 A | | 12/1994 |
| JP | 07324400 A | * | 12/1995 |
| JP | 2993370 B | | 10/1999 |
| JP | 3024525 B | | 1/2000 |

* cited by examiner

*Primary Examiner*—Edgardo San Martin
(74) *Attorney, Agent, or Firm*—Smith Patent Office

(57) ABSTRACT

In order to provide a sound-absorbing panel and a production method of the same which has excellent freedom of design and have small differences in the maximum sound-absorbing coefficients among products, a sound-absorbing panel is adopted which is characterized by a panel main body which is constituted by arranging both a porous veneer of 0.02-0.5 mm thickness with multiple pierced apertures of 0.1 mm or smaller aperture diameters or 0.2 mm or smaller aperture diameters and a porous sound-absorbing base material set at a backside of the porous veneer so as to be overlapped, and is characterized by having a value of airflow resistance in a range of 0.1-1.0 Pa.

8 Claims, 10 Drawing Sheets

SOUND-ABSORBING PANEL AND PRODUCTION METHOD OF THE SAME

BACKGROUND OF THE INVENTION

1. Field of the Invention

The present invention relates to a sound-absorbing panel and a production method of the same.

Priority is claimed on Japanese Patent Application No. 2006-097002, filed Mar. 31, 2006, and Japanese Patent Application No. 2007-001186, filed Jan. 9, 2007, the contents of which are incorporated herein by reference.

2. Description of Related Art

Conventionally, a sound-absorbing panel constituted from a porous plate, a sound-absorbing panel which has a constitution of combination of both the porous plate and a porous sound-absorbing material are generally known. Japanese Patent Application No. H06-348281 discloses a sound absorbing panel which is constituted by providing multiple open aperture portions on a plate member, and by pressing, adhering and integrating the open aperture portions with a metallic porous sound-absorbing material of the same shape as these open aperture portions.

Moreover, Japanese Patent No. 3024525 discloses a metallic plate on which pierced apertures are evenly and uniformly provided, and which reduces the sound reflection rate.

Furthermore, Japanese Patent No. 2993370 discloses a sound-absorbing veneer plate which is constituted by adhering a sound-absorbing base material and a veneer material, and which is constituted by forming multiple small apertures of 0.05-0.5 mm opening diameter on the veneer plate.

On the other hand, there are many cases in which sound-absorbing panels are used as materials of a wall surface of a building; therefore, not only sound-absorbing characteristics, but also aesthetic appeal or visual appeal of the sound-absorbing panel itself is required.

However, with respect to the sound-absorbing panel described in Japanese Patent Application, First Publication No. H06-348281, as shown in FIGS. 8 and 9, the size of the open aperture is approximately as large as can be recognized by the naked eye; therefore, the metallic porous sound-absorbing material filled in this open aperture is in a state which can be recognized by the naked eye. Therefore, there is a problem in which the appearance of this sound-absorbing plate is determined in accordance with the size of the open aperture and the appearance of the metallic porous sound-absorbing material, and there is a small freedom of design.

Moreover, with respect to the metallic plate disclosed in Japanese Patent No. 3024525, as shown in FIGS. 1-8, a radius of the pierced aperture is set to be 8-28 mm, gaps or intervals between the pierced apertures are set to be 20-100 mm which are comparatively large; and therefore, the pierced apertures are set to be a size which can be recognized by the naked eye. Therefore, there is a problem in which the appearance of the metallic plate is mainly determined in accordance with the radius and intervals of the pierced apertures, and there is a small freedom of design.

Moreover, the sound-absorbing veneer disclosed in Japanese Patent No. 2993370 has limitations to the material of the veneer because a pulse laser processing machine is used upon forming fine or small apertures on the veneer; therefore, there is a problem in which the freedom of designing is small.

Moreover, with respect to the sound-absorbing plate which is obtained by combining the porous plate and the porous sound-absorbing material as described in Japanese Patent Application, First Publication No. H06-348281 or Japanese Patent No. 2993370, there is a case in which fiber sound-absorbing material such as glass wool, rock wool, and the like is used as the porous sound-absorbing material, and there is a case in which a granular sound-absorbing material that is obtained by solidifying and forming granular mineral material such as pearlite, silver sand, and the like is used. There are many cases in which the percentage of void space is applied as an indicator or an index upon choosing the constitutional material of the sound-absorbing plate among them. However, inside the fiber sound-absorbing material and the granular sound-absorbing material, vacant spaces are generated in different ways; therefore, a relationship between the percentage of void space and the maximum sound-absorbing coefficient is not uniform or constant. It is not necessarily possible to obtain a sound-absorbing plate which has an excellent maximum sound-absorbing coefficient even if the percentage of void space is applied as the indicator and the porous sound-absorbing material is selected. Moreover, even in a case in which the same fiber sound-absorbing material is used, there is possibility that the sound-absorbing coefficient is different in accordance with the thickness or length of the fiber even though the percentage of void space is the same, and even in a case in which the same granular sound-absorbing material is used, there is possibility that the sound-absorbing coefficient is different in accordance with a size of inorganic powders or inorganic particles or in accordance with adhering or sticking state of a bonding agent even though the percentage of void space is the same. In other words, even if the percentage of void space is the same, there is a difference in pass or channel in which air flows in accordance with the constitutional members; therefore, a relationship between the percentage of void space and the sound-absorbing coefficient is not uniform or constant.

Therefore, there are cases in which there are differences in the maximum sound-absorbing coefficient depending on the state of the constitutional members even though the porous sound-absorbing material of the same percentage of void space is applied; therefore, there are cases in which there are differences in sound-absorbing characteristics even though the sound-absorbing plate has the same constitution.

The present invention was devised with respect to the above-described backgrounds, and has an object to provide a sound-absorbing panel and a production method of the same which have excellent freedom of design and have small differences in the maximum sound-absorbing coefficients among the products.

SUMMARY OF THE INVENTION

Inventors of the present invention have eagerly studied the relationship between the physical properties of the sound-absorbing panel and the maximum sound-absorbing coefficient, a close relationship was found between the value of the airflow resistance and the maximum sound-absorbing coefficient when the porous veneer and the porous sound-absorbing base material are combined, and a phenomena was found in which an excellent maximum sound-absorbing coefficient is obtained when the value of the airflow resistance is in a specific range.

In other words, a sound-absorbing panel includes a panel main body, wherein the panel main body includes both a porous veneer of 0.02-0.5 mm thickness which includes pierced apertures of 0.2 mm or smaller aperture diameters or 0.1 mm or smaller aperture diameters, and a porous sound-absorbing base material arranged at a backside of the porous veneer. The panel main body is constituted by arranging the porous veneer and the porous sound-absorbing base material so as to be overlapped. The value of the airflow resistance of the panel main body is in the range of 0.1-1.0 Pa.

Moreover, it is preferable that, with respect to the above-described sound-absorbing panel, the value of the airflow resistance of the porous sound-absorbing base material be in a range of 0.1-0.8 Pa.

As another aspect of the present invention, a sound-absorbing panel includes a panel main body, wherein the panel main body includes both a porous veneer of 0.02-0.5 mm thickness which includes pierced apertures of 0.2 mm or smaller aperture diameters or 0.1 mm or smaller aperture diameters, and a supporting base material arranged at the backside of the porous veneer. The panel main body is constituted by arranging the porous veneer and the supporting base material so as to be overlapped. The value of the airflow resistance of the panel main body is in the range of 0.1-1.0 Pa.

It is preferable that the supporting base material of the above-described sound-absorbing panel be a honeycomb structure material, a punching metal or an expanded metal.

Moreover, it is preferable that, with respect to the above-described sound-absorbing panel, both the porous veneer and the porous sound-absorbing base material or the supporting base material be detachably attached.

Moreover, it is preferable that, with respect to the above-described sound-absorbing panel, a backside air layer be provided at the backside of the porous sound-absorbing base material or the supporting base material.

Next, a production method of a sound-absorbing panel includes the steps of: forming a porous veneer by forming a plurality of pierced apertures of 0.2 mm or smaller aperture diameters or 0.1 mm or smaller aperture diameters on a veneer of 0.024-0.5 mm thickness; and constituting a panel main body by arranging a porous sound-absorbing base material or a supporting base material at the backside of the porous veneer to be overlapped, along with setting a value of the airflow resistance of the panel main body in the range of 0.1-1.0 Pa.

Moreover, it is preferable that, with respect to the above-described production method of a sound-absorbing panel, a design be applied to a surface of the porous veneer opposite to the backside.

In accordance with the above-described sound-absorbing panel, the value of resistance of air flow of the panel main body is in the range of 0.1-1.0 Pa. Therefore, it is possible to indicate a 60% or larger maximum sound-absorbing coefficient.

Moreover, instead of the percentage of void space, the value of the airflow resistance which has a comparatively strong relationship with the maximum sound-absorbing coefficient is used. Therefore, there is no possibility in which there are differences of the maximum sound-absorbing coefficients of the sound-absorbing panels among products, and it is possible to constitute the sound-absorbing panel with stable sound-absorbing characteristics.

Moreover, the aperture diameter of the pierced aperture is comparatively small. Therefore, the pierced aperture is not conspicuous or an eyesore, and it is possible to freely design the appearance of the sound-absorbing panel without being affected by the pierced aperture.

Moreover, in accordance with the above-described sound-absorbing panel, the value of the airflow resistance of the porous sound-absorbing base material is in the range of 0.1-0.8 Pa. Therefore, when the panel main body is constituted, there is no possibility in which the value of the resistance of airflow of the panel main body is out of the range of 0.1-1.0 Pa, and it is possible to achieve excellent sound-absorbing characteristics.

Moreover, if the supporting base material is applied, it is possible to increase the strength of the sound-absorbing panel.

Moreover, in accordance with the above-described sound-absorbing panel, the porous veneer and the porous sound-absorbing base material or the supporting base material are respectively detachable. Therefore, it is possible to easily change or replace only the porous veneer after setting or installing the sound-absorbing panel, and it is possible to easily change the design by changing or replacing only the porous veneer in a case in which a design is applied on the porous veneer.

Moreover, in accordance with the production method of the sound-absorbing panel, when the panel main body is constituted by arranging both the porous veneer and the porous sound-absorbing base material so as to be overlapped, the value of the airflow resistance of the panel main body is set to be 0.1-1.0 Pa. Therefore, it is possible to roughly fix the maximum sound-absorbing coefficient of the sound-absorbing panel at the production steps of the sound-absorbing panel, and it is possible to produce the sound-absorbing panels without differences of the sound-absorbing characteristics among the products.

Moreover, in accordance with the production method of the sound-absorbing panel, a design or decoration is applied on the veneer before forming the porous veneer. Therefore, there is no possibility in which the pierced apertures on the porous veneer are closed or covered by paint and the like used for designing, and it is possible to produce the sound absorbing panel with excellent sound-absorbing characteristics.

DETAILED DESCRIPTION OF THE INVENTION

Figure 1:
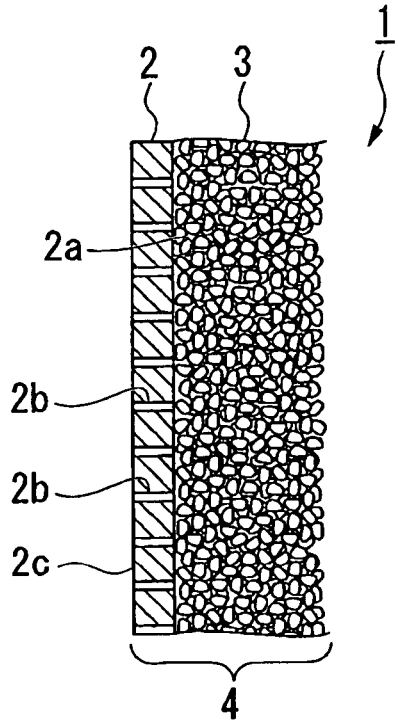
FIG. 1 is an outline drawing of a cross-section showing an example of a sound-absorbing panel of an embodiment of the present invention.

Hereinafter, a sound-absorbing panel and a production method of the same of the present invention are explained in reference to drawings. The drawings referred to below are used for explaining a constitution of the sound-absorbing panel and the like, and there is possibility in which size, thickness, length, and the like of portions shown in the drawings are different from the physical relationship of the sound-absorbing panel and the like.

Figure 2:
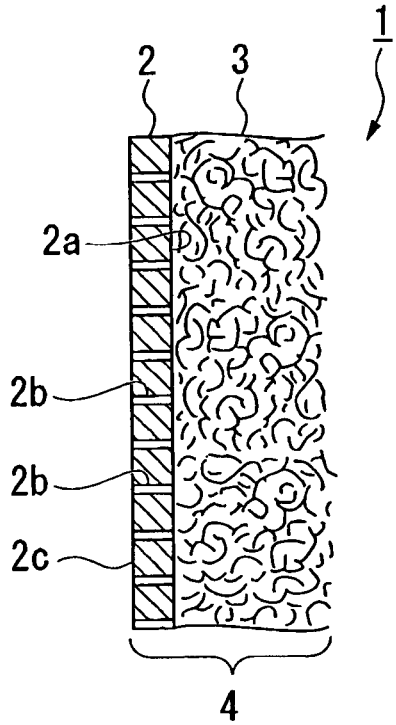
FIG. 2 is an outline drawing of a cross-section showing another example of a sound-absorbing panel of an embodiment of the present invention.

FIG. 1 is an outline drawing of a cross-section showing an example of the sound-absorbing panel of this embodiment, and FIG. 2 is an outline drawing of a cross-section showing another example of the sound-absorbing panel of this embodiment.

The sound-absorbing panel shown in FIGS. 1 and 2 are constituted from a porous veneer 2 and a porous sound-absorbing base material 3 arranged at a backside 2*a* of the porous veneer 2. A panel main body 4 is constituted by arranging both the porous veneer 2 and the porous sound-absorbing base material 3 so as to be overlapped.

The porous veneer 2 is made from a metallic plate, a wood plate, a resin plate, a sheet of paper, and the like in a range of 0.02-0.5 mm thickness, and multiple pierced apertures 2*b* piercing in the thickness direction which have 0.1 mm or smaller aperture diameter or 0.2 mm or smaller aperture diameter are provided on the porous veneer 2. Such the multiple pierced apertures 2*b* are provided. Therefore, it is possible that air and sound pass through the porous veneer 2. Moreover, the pierced apertures 2*b* have not only a function of passing or transmitting the air and the sound, but also a function of absorbing the sound. The aperture diameters of the pierced apertures 2*b* are set to be approximately 0.1 mm or smaller or 0.2 mm or smaller, that is, it is difficult to recognize the pierced apertures 2*b* by a naked eye, and it is possible to maintain an aesthetically pleasant appearance in the porous veneer 2.

It should be noted that, when the porous veneer 2 is made from a metallic plate, material can be, for example, stainless steel, aluminum, aluminum alloy, copper, a ferronickel alloy such as invar, and the like.

Moreover, the shape of the pierced aperture 2*b* seen on the surface can be a completely circular, an oval shape or rectangular. In the case of a completely circular shape, the aperture diameter is the diameter of the circle, in the case of an oval shape, the aperture diameter is a major axis of the oval, and in a case of the rectangular shape, the aperture diameter is a long side of the rectangle.

Moreover, on a front surface 2*c* of the porous veneer 2, in order to improve beauty of the appearance, it is possible to apply a design such as a drawing, a figure, a pattern, or the like, and it is possible to apply a mirror finish on the front surface 2*c*.

Moreover, as described above, the thickness of the porous veneer 2 is preferably in the range of 0.02-0.5 mm. It is not preferable if the thickness is less than 0.02 mm because it is difficult to deal with the porous veneer 2, and it is not preferable if the thickness is larger than 0.5 mm because it is difficult to efficiently form the porous veneer 2.

Moreover, an aperture ratio or an opening ratio of the pierced apertures 2*b* is preferably in a range of 0.2-40%, and more preferably in a range of 1-20%. Here, the aperture ratio of the pierced apertures 2*b* is a ratio of aperture areas of the pierced apertures 2*b* to an area of the front surface 2*c* or the back surface 2*a* of the porous veneer 2. If the aperture ratio is 0.2% or larger, it is possible to maintain or keep the value of the airflow resistance of the porous veneer 2 itself so as to be 1 Pa or smaller, and moreover, it is possible to maintain or keep the value of the airflow resistance of the panel main body 4 so as to be 1 Pa or lower when the panel main body 4 is constituted by piling up or laminating the porous sound-absorbing base materials 3 so as to be overlapped. Moreover, if the aperture ratio is 40% or less, the pierced aperture is not conspicuous or an eyesore, and there is no possibility to affect undesirable influence on an aesthetically pleasant appearance of the porous veneer 2.

Next, it is possible that the porous sound-absorbing base material 3, as shown in FIG. 1, be a granular porous material which is constituted by sintered or binding glass particles, mineral particles, ceramic particles, resin particles, and the like, and moreover, it is possible that the porous sound-absorbing base material 3, as shown in FIG. 2, be a porous material in a fiber state constituted by twining glass fiber, resin fiber, metallic fiber, natural fiber such as cotton, and the like. It is appropriate in a case of applying the granular porous material shown in FIG. 1 that a diameter of each particle be approximately 0.1-2 mm. It is appropriate in a case of applying the porous material in a fiber state shown in FIG. 2 that glass particles, mineral particles, ceramic particles, resin particles, and the like be filled between the fibers.

A thickness of the porous sound-absorbing base material 3 is preferably 1 mm or thicker, more preferably in the range of 1-50 mm, and most preferably in the range of 1-20 mm. If the thickness is 1 mm or thicker, there is no danger or possibility in which the value of the airflow resistance of the porous sound-absorbing base material 3 is reduced, and it is possible to increase the value of the airflow resistance of the panel main body 4 so as to be 0.1 Pa or larger. Moreover, from a viewpoint of sound-absorbing characteristics, there is no limitation on the thickness of the porous sound-absorbing base material 3. However, from a viewpoint of handling, usability or processing, it is preferable to set the upper limit to be 50 mm or thinner.

The percentage of void space of the porous sound-absorbing base material 3 is preferably in the range of 5-90%, and more preferably in the range of 5-40%. If the percentage of void space is 5% or larger, there is no danger or possibility to severely increase the value of the airflow resistance. Moreover, if the percentage of void space is 90% or smaller, there is no danger or possibility to lose the mechanical strength of the porous sound-absorbing base material 3.

It should be noted that, as described above, the relationship between the percentage of void space of the porous sound-absorbing base material 3 and the maximum sound-absorbing coefficient is not uniform or constant. Therefore, if the porous sound-absorbing base material 3 is selected in reference to the percentage of void space as an index or indicator, it is not necessarily possible to obtain the sound-absorbing panel 1 which has an excellent maximum sound-absorbing coefficient. Therefore, the percentage of void space can be referred. However, it is not very important.

Next, the value of the airflow resistance of the porous sound-absorbing base material 3 is preferably in the range of 0.1-0.8 Pa, and more preferably in the range of 0.1-0.3 Pa. If the value of the airflow resistance of the porous sound-absorbing base material 3 is 0.1 Pa or larger, even in a case in which the value of the airflow resistance of the porous veneer 2 is very close to 0 Pa, it is possible to obtain the value of the airflow resistance of the panel main body 4 so as to be 0.1 Pa or larger. Moreover, if the value of the airflow resistance of the porous sound-absorbing base material 3 is 0.8 Pa or less, even in the case in which the value of the airflow resistance of the porous veneer 2 is a comparatively small value, it is possible to obtain the value of the airflow resistance of the panel main body 4 so as to be 1 Pa or smaller. Moreover, as described below, the sound-absorbing coefficient of the panel main body 4 indicates 80% or larger when the value of the airflow resistance of the panel main body 4 is in the range of 0.15-0.5 Pa. Therefore, in consideration of an increase by the porous veneer 2, it is more preferable to set the value of the airflow resistance of porous sound-absorbing base material 3 so as to be 0.3 Pa or less.

Furthermore, the surface density of the porous sound-absorbing base material 3 is preferably 8 kg/m$^2$ or smaller from a viewpoint of reducing the weight of the panel main body 4.

It is possible to adhere both the porous veneer 2 and the porous sound-absorbing base material 3 by using an adhesive or to be detachably attached by using metal fittings, a jig, or the like. Especially when they are detachably attached, it is easy to replace the porous veneer 2 and it is possible to change the overall design of the porous veneer 2.

Figure 3:
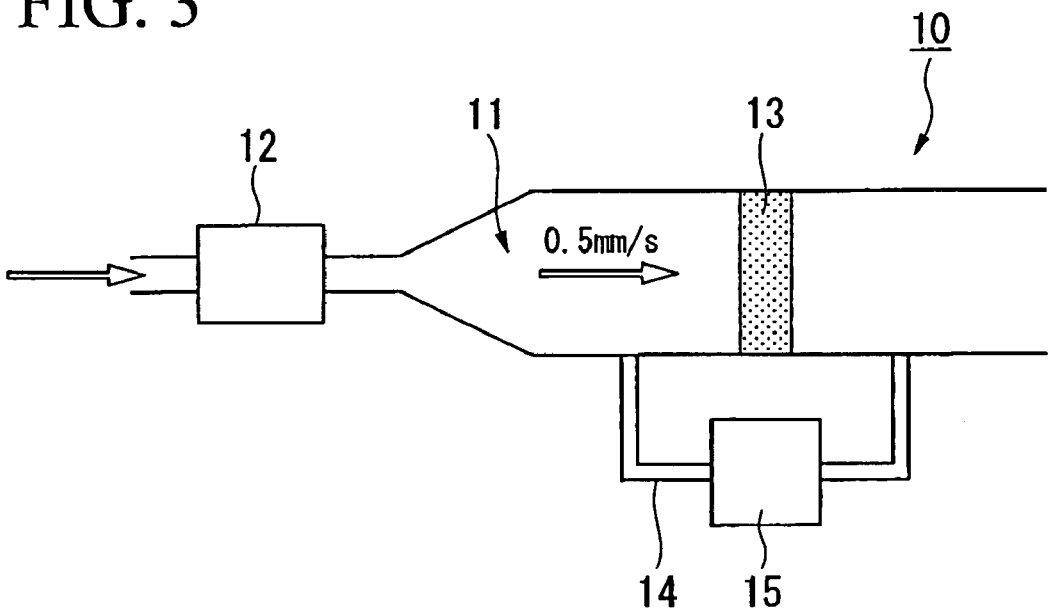
FIG. 3 is an outline drawing showing a measuring apparatus of a value of the airflow resistance.

Next, the value of the airflow resistance is explained. The value of the airflow resistance is an index or indicator which is defined in JIS (Japanese Industrial Standard) A6306 and which is applied to a flow resistance of a unit area, and is an index measured by using a measurement apparatus as shown in FIG. 3. A measurement apparatus 10 shown in FIG. 3 is roughly constituted from: a channel 11 for flowing air; a flow meter 12 which is arranged on an upper stream side of the channel 11 and which adjusts a flow velocity of the air; a sample 13 (panel main body 4) which is arranged on the way of the cannel 11; a bypass channel 14 which bypasses from an upper stream side to a lower stream side of the sample 13; and a differential pressure gauge 15 which is arranged on the channel 14. An airflow velocity at an upper stream side of the sample 13 is set to be 0.5 mm/sec. By using the measurement apparatus 10 constituted in such a manner, a differential pressure indicated by the differential pressure gauge 15 is detected and the value of the airflow resistance is measured.

With respect to the sound-absorbing panel 1 of this embodiment, the value of the airflow resistance of the panel main body 4 is preferably in the range of 0.1-1.0 Pa, more preferably in the range of 0.15-0.5 Pa, and most preferably in the range of 0.2-0.45 P. If the value of the airflow resistance of the panel main body 4 is in the range of 0.1-1.0 Pa, it is possible to achieve a 60% or larger maximum sound-absorbing coefficient of the sound-absorbing panel 1, moreover, if the value of the airflow resistance of the panel main body 4 is in the range of 0.15-0.5 Pa, the sound-absorbing coefficient of the sound-absorbing panel 1 can be 80% or larger, and furthermore, if the value of the airflow resistance of the panel main body 4 is in the range of 0.2-0.45 Pa, the sound-absorbing coefficient of the sound-absorbing panel 1 can be 90% or larger.

Figure 4:
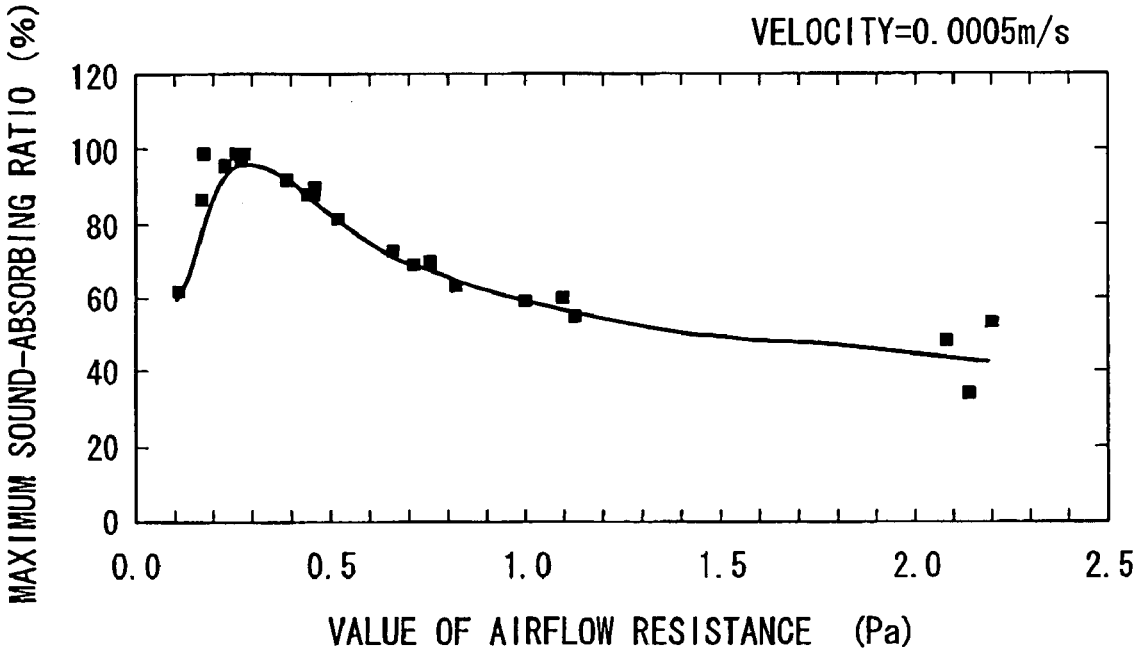
FIG. 4 is a graph showing a relationship between maximum sound-absorbing coefficients and the values of the airflow resistance based on measured results of normal incidence sound-absorbing characteristics of the sound-absorbing panels of samples No. 1-25.

FIG. 4 is a graph showing a relationship between maximum sound-absorbing coefficients and the values of the airflow resistance based on measured results of normal incidence sound-absorbing characteristics of the sound-absorbing panels of samples No. 1-25. This FIG. 4 is obtained by plotting the relationship between the maximum sound-absorbing coefficient and the value of the airflow resistance based on measured results of normal incidence sound-absorbing characteristics of 21 kinds of sound absorbing panels which are constituted by laminating, adhering or combining the porous veneer and the porous sound-absorbing base material so as to have the values of resistance of airflow in the range of 0.1-2.2 Pa. It should be noted that constitutions of the porous veneer (materials, thickness, aperture diameters of the pierced apertures, aperture ratio) and constitutions of the porous sound-absorbing base material (materials, thickness, percentage of void space, value of the airflow resistance) are as shown in Table 1. It should be noted that in Table 1, GW23K, GW32K, GW39K, GW44K, GW51K, GW62K and GW72K are glass wools of ASAHI FIBER GLASS Co., Ltd., Altone (registered trademark) is an aluminum fiber sheet made by NICHIAS Corporation, cerathone (registered trademark) is a ceramic particle sintered material made by NGK INSULATORS LTD.

As shown in Table 1 and FIG. 4, the maximum sound-absorbing coefficient indicates a maximum value of almost 100% when the value of the airflow resistance is 0.25 Pa. However, the maximum sound-absorbing coefficient is reduced along with an increase of the value of the airflow resistance, and the maximum sound-absorbing coefficient decreases and is approximately 40-50% when the value of the airflow resistance is 2.2 Pa. Thus, with respect to the sound-absorbing panel constituted by arranging both the porous veneer and the porous sound-absorbing base material so as to be overlapped, it is understood that the maximum sound-absorbing coefficient is reduced along with the increase of the value of the airflow resistance. Therefore, it is necessary to provide an upper limit of the value of the airflow resistance to the sound-absorbing panel 1, and the upper limit is 1.0 Pa here.

TABLE 1

| | POROUS VENEER | | | | POROUS SOUND-ABSORBING BASE MATERIAL | | | PANEL | |
|---|---|---|---|---|---|---|---|---|---|
| SAMPLE NO. | MATERIAL | THICKNESS (μM) | APERTURE DIAMETER OF PIERCED APERTURE (μM) | APERTURE RATIO (%) | MATERIAL | THICKNESS (μM) | VALUE OF RESISTANCE OF AIRFLOW (PA) | VALUE OF RESISTANCE OF AIRFLOW (PA) | MAXIMUM SOUND-ABSORBING COEFFICIENT (%) |
| 1 | SUS | 50 | 70 | 30.9 | GW23K | 50 | 0.17 | 0.18 | 99 |
| 2 | SUS | 50 | 70 | 30.9 | GW32K | 50 | 0.26 | 0.27 | 98 |
| 3 | SUS | 50 | 70 | 30.9 | GW39K | 50 | 0.43 | 0.44 | 88 |
| 4 | SUS | 50 | 70 | 30.9 | GW44K | 50 | 0.51 | 0.52 | 82 |

TABLE 1-continued

| | POROUS VENEER | | | | POROUS SOUND-ABSORBING BASE MATERIAL | | | PANEL | |
|---|---|---|---|---|---|---|---|---|---|
| SAMPLE NO. | MATERIAL | THICKNESS (μM) | APERTURE DIAMETER OF PIERCED APERTURE (μM) | APERTURE RATIO (%) | MATERIAL | THICKNESS (μM) | VALUE OF RESISTANCE OF AIRFLOW (PA) | VALUE OF RESISTANCE OF AIRFLOW (PA) | MAXIMUM SOUND-ABSORBING COEFFICIENT (%) |
| 5 | SUS | 50 | 70 | 30.9 | GW51K | 50 | 0.7 | 0.72 | 69 |
| 6 | SUS | 50 | 70 | 30.9 | GW62K | 50 | 1.07 | 1.1 | 60 |
| 7 | SUS | 50 | 70 | 30.9 | GW72K | 50 | 2.13 | 2.14 | 34 |
| 8 | SUS | 20 | 70 | 30.9 | GW32K | 50 | 0.26 | 0.23 | 96 |
| 9 | SUS | 100 | 70 | 30.9 | GW32K | 50 | 0.26 | 0.28 | 99 |
| 10 | SUS | 500 | 70 | 30.9 | GW32K | 50 | 0.26 | 0.46 | 90 |
| 11 | SUS | 20 | 70 | 0.2 | GW32K | 50 | 0.26 | 0.76 | 70 |
| 12 | SUS | 50 | 70 | 0.2 | GW32K | 50 | 0.26 | 2.08 | 48 |
| 13 | SUS | 50 | 70 | 30.9 | ALTONE | 1 | 0.16 | 0.17 | 87 |
| 14 | SUS | 50 | 70 | 3.6 | ALTONE | 1 | 0.16 | 0.46 | 88 |
| 15 | SUS | 50 | 70 | 0.9 | ALTONE | 1 | 0.16 | 0.66 | 73 |
| 16 | SUS | 50 | 70 | 30.9 | ALTONE | 1 | 0.16 | 0.17 | 87 |
| 17 | PET | 50 | 70 | 30.9 | CERATHONE | 20 | 0.16 | 0.26 | 99 |
| 18 | PET | 50 | 70 | 3.6 | CERATHONE | 20 | 0.16 | 0.39 | 92 |
| 19 | PET | 50 | 70 | 0.9 | CERATHONE | 20 | 0.16 | 0.52 | 88 |
| 20 | SUS | 50 | 70 | 40 | GW23K | 20 | 0.11 | 0.11 | 62 |
| 21 | PAPER | 200 | 100 | 0.9 | ALTONE | 1 | 0.16 | 0.76 | 69 |
| 22 | WOOD | 200 | 100 | 0.9 | ALTONE | 1 | 0.16 | 1.02 | 61 |
| 23 | WOOD | 200 | 90 | 0.7 | ALTONE | 1 | 0.16 | 1.13 | 55 |
| 24 | SUS | 500 | 70 | 3.6 | ALTONE | 1 | 0.16 | 2.2 | 53 |
| 25 | SUS | 50 | 70 | 30.9 | GW56K | 50 | 0.8 | 0.82 | 63 |

When the sound-absorbing panel 1 is produced, it is sufficient to prepare the porous veneer 2 and the porous sound-absorbing base material 3 and to adhere both of them so as to be overlapped or to detachably attach them along with setting the value of the airflow resistance in the range of 0.1-1.0 Pa.

Figure 5:
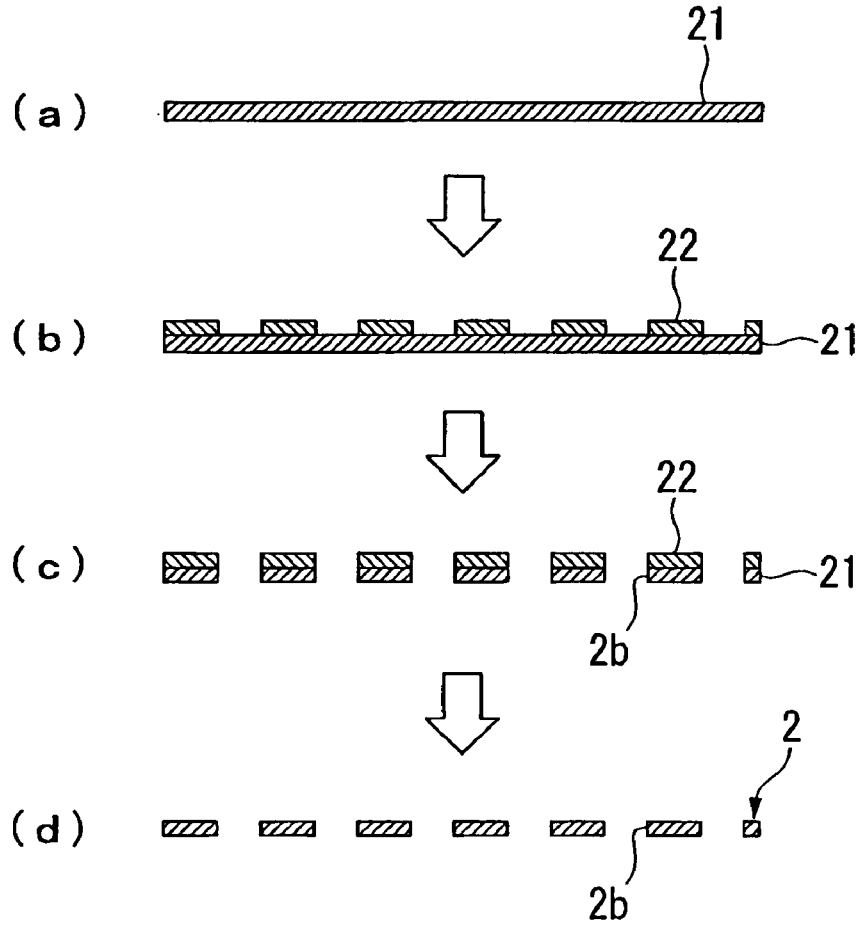
FIG. 5 is a flow chart showing one example of production steps of a porous veneer.

In order to produce the porous veneer 2, for example, as shown in FIG. 5, a production method can be explained in which a veneer 21 of a thickness in the range of 0.02-0.5 mm is prepared (FIG. 5(*a*)), a masking layer 22 is formed on an overall surface of the veneer 21 as shown in FIG. 5(*b*), and as shown in FIG. 5(*c*), pierced apertures 2*b* are formed on a portion exposed out of the masking layer 22 by operating EB (Electron Beam) processing, etching or sand blasting. In this case, it is preferable to apply a metallic plate as a material of the veneer 21.

Figure 6:
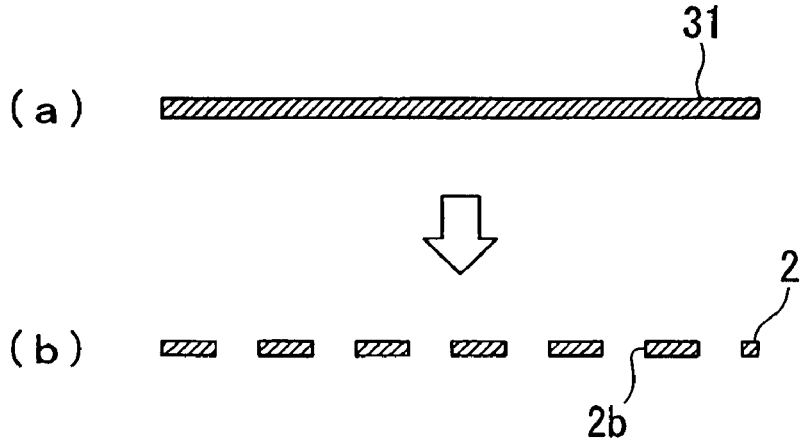
FIG. 6 is a flow chart showing another example of production steps of the porous veneer.

It is possible to apply another production method in which, first, a veneer 31 (FIG. 6(*a*)) is provided as shown in FIG. 6, and next, the pierced apertures 2*b* are formed by laser machining as shown in FIG. 6(*b*). In this case, a wood board, a resin board, paper, and the like are preferable as a material of the veneer 31.

It should be noted that in either case of these two production methods, it is preferable to process designs such as drawings or patterns on the veneer 21/31 beforehand.

Moreover, with respect to adjustment of the value of the airflow resistance, for example, it is possible to adjust by changing both the constitution of the porous veneer 2 (thickness, aperture diameters of the pierced apertures 2*b*, aperture ratio) and the constitution of the porous sound-absorbing base material 3 (thickness, percentage of void space, value of the airflow resistance) inside the above-described ranges. Moreover, it is possible to adjust by adhering the porous sound-absorbing base material 3 to the porous veneer 2 and by further adhering other porous sound-absorbing base materials.

As described above, in accordance with the sound-absorbing panel 1, the value of the resistance of airflow of the panel main body 4 is in the range of 0.1-1.0 Pa. Therefore, it is possible to achieve excellent sound-absorbing characteristics.

Moreover, the value of the airflow resistance which has a comparatively strong relationship with the maximum sound-absorbing coefficient is used. Therefore, there is no possibility in which there are differences in the maximum sound-absorbing coefficients of the sound-absorbing panels 1 among the products, and it is possible to constitute the sound-absorbing panel 1 with stable sound-absorbing characteristics.

Moreover, the value of the airflow resistance of the porous sound-absorbing base material 3 is in the range of 0.1-0.8 Pa. Therefore, when the panel main body 4 is constituted, there is no possibility in which the value of the resistance of airflow of the panel main body 4 is out of the range of 0.1-1.0 Pa, and it is possible to achieve excellent sound-absorbing characteristics.

Moreover, the porous veneer 2 and the porous sound-absorbing base material 3 are respectively detachable. Therefore, it is possible to easily change or replace only the porous veneer 2 after setting or installing the sound-absorbing panel 1, and it is possible to easily change the design by changing or replacing only the porous veneer 2 in a case in which a design is applied on the porous veneer 2.

Moreover, in accordance with the above-described production method of the sound-absorbing panel 1, the value of the airflow resistance of the panel main body 4 is set to be 0.1-1.0 Pa. Therefore, it is possible to roughly fix the maximum sound-absorbing coefficient of the sound-absorbing panel 1 at the production steps of the sound-absorbing panel 1, and it is possible to produce the sound-absorbing panels 1 without differences in the sound-absorbing characteristics among the products.

Moreover, a design or decoration is applied on the veneer 21/31 before forming the porous veneer 2. Therefore, there is no possibility in which the pierced apertures 2*b* on the porous veneer 2 are closed or covered by paint or the like used for design, and it is possible to produce the sound absorbing panel 1 with excellent sound-absorbing characteristics.

Moreover, with respect to the sound-absorbing panel 1 of this embodiment, it is possible to constitute the panel main body by arranging a supporting base material so as to be overlapped to the porous veneer, and by setting the value of the airflow resistance of the panel main body in the range of 0.1-1.0 Pa. It is possible to apply, for example, a honeycomb constitution material, a punching metal or an expanded metal as the supporting base material.

In accordance with the above-described sound-absorbing panel providing the supporting base material, the value of the airflow resistance is in the range of 0.1-1.0 Pa. Therefore, it is possible to achieve excellent sound-absorbing characteristics, and it is possible to increase the strength of the sound-absorbing panel because of the supporting base material.

Moreover, with respect to the sound absorbing panel of the present invention, it is possible to provide a backside air layer at the backside of the above-described porous sound-absorbing base material or the above-described supporting base material. By providing the backside air layer, it is possible to further increase the sound-absorbing characteristics.

EXAMPLES

Example 1

A porous veneer which has 30.9% aperture ratio is produced by forming pierced apertures of 70 μm diameter (0.07 mm) with 0.12 mm intervals between them by applying sand-blast on a veneer which is a stainless veneer of 50 μm (0.05 mm) thickness prepared beforehand and on which design is processed beforehand.

Next, as the porous sound-absorbing base material, a glass wool of 50 mm thickness (product name: glass wool 32K, produced by ASAHI FIBER GLASS Co., Ltd) was prepared and the panel main body was formed by adhering this porous sound-absorbing base material to the porous veneer. The value of the airflow resistance of the panel main body was 0.3 Pa. The sound-absorbing panel of the example 1 is produced in such manner.

Figure 7:
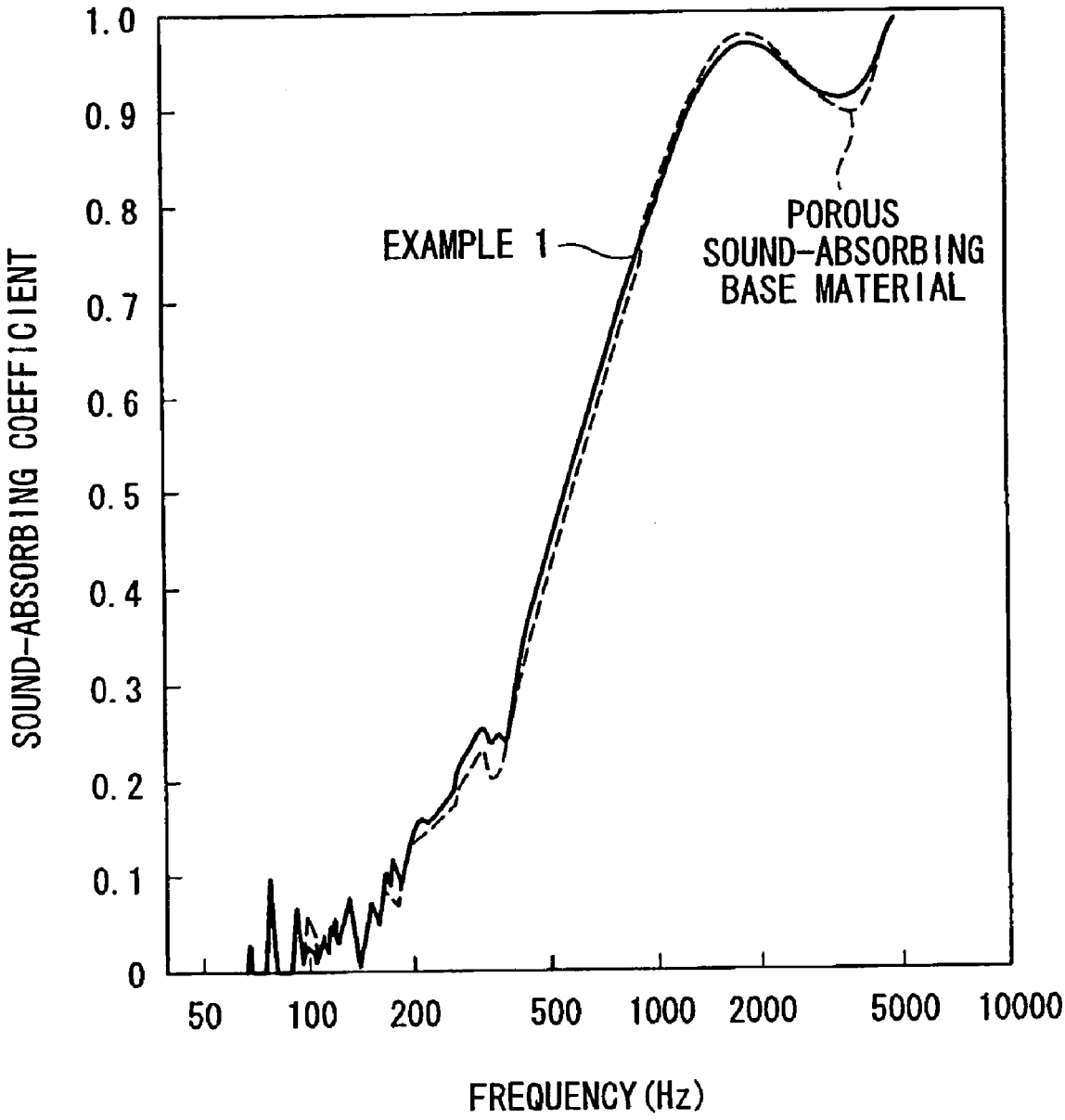
FIG. 7 is a graph showing the frequency dependency of normal incidence sound-absorbing characteristics of a first embodiment.

With respect to the sound-absorbing panel of the example 1, normal incidence sound-absorbing characteristics are measured in the case of setting the thickness of the backside air layer to be 0 mm. FIG. 7 shows the results. FIG. 7 shows normal incidence sound-absorbing characteristics measured in the case of applying only the porous sound-absorbing base material of 50 mm thickness (product name: glass wool 32K, produced by ASAHI FIBER GLASS Co., Lid) as well.

As shown in FIG. 7, compared to the case of applying only the porous sound-absorbing base material, it is recognized that normal incidence sound-absorbing characteristics of the sound-absorbing panel of the example 1 is increased to some degree. The cause of this result is inferred that, compared to the case of applying only the porous sound-absorbing base material, the value of the airflow resistance is increased to some degree by combining the porous sound-absorbing base material and the porous veneer, and therefore, the sound-absorbing characteristics are improved.

Example 2

The porous veneer was produced in the same manner as the example 1 except for processing an etching on the veneer.

Next, as the porous sound-absorbing base material, an aluminum sheet of 1 mm thickness (product name: Altone, produced by NICHIAS Corporation) was prepared and the panel main body was formed by adhering this porous sound-absorbing base material to the porous veneer. The value of the airflow resistance of the panel main body was 0.2 Pa. The sound-absorbing panel of the example 2 is produced in such a manner.

Figure 8:
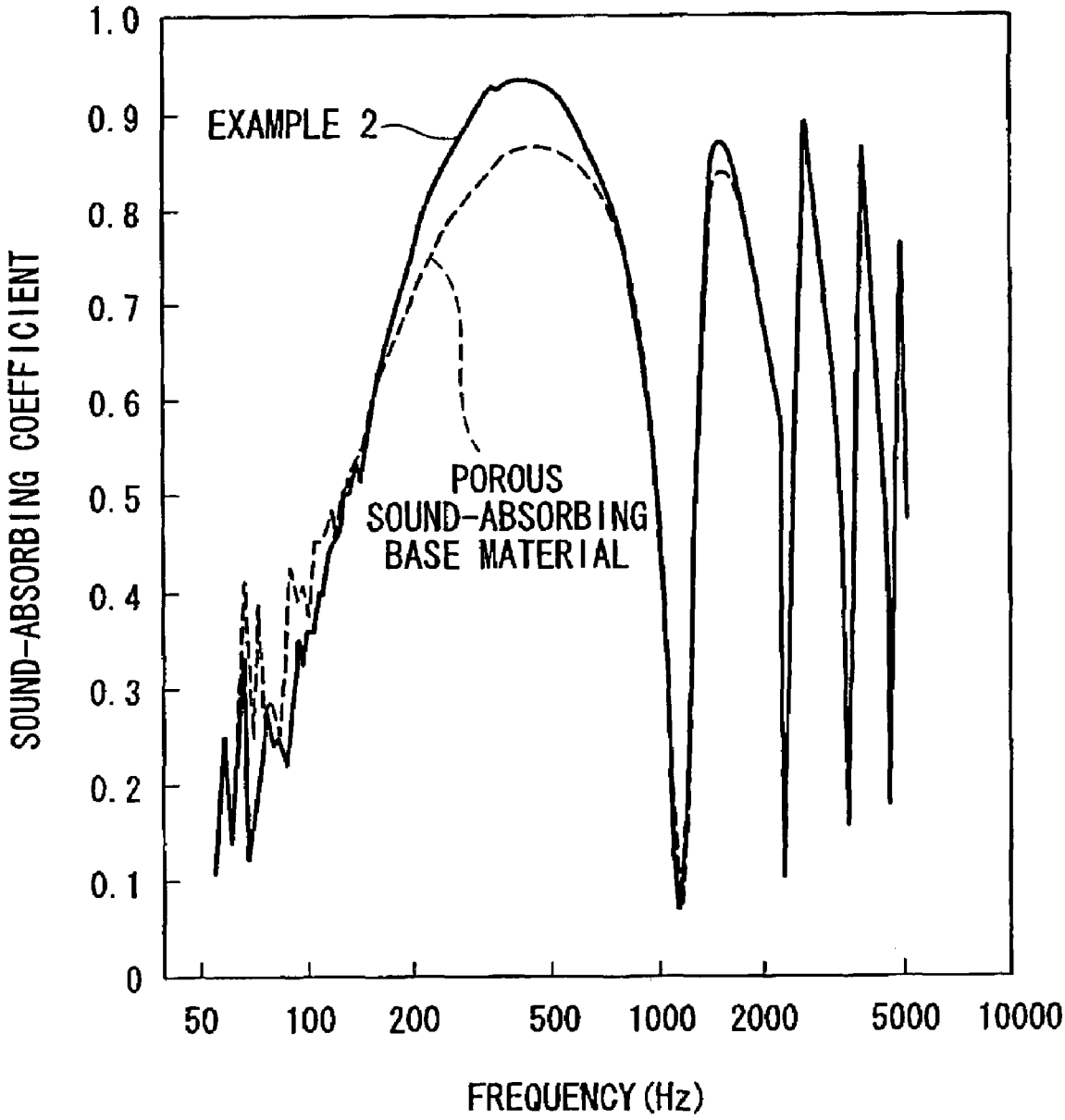
FIG. 8 is a graph showing the frequency dependency of normal incidence sound-absorbing characteristics of a second embodiment.

With respect to the sound-absorbing panel of the example 2, normal incidence sound-absorbing characteristics are measured in the case of setting the thickness of the backside air layer to be 150 mm. FIG. 8 shows the results. FIG. 8 shows normal incidence sound-absorbing characteristics measured in the case of applying only the porous sound-absorbing base material of 1 mm thickness (product name: Altone, produced by NICHIAS Corporation) as well.

As shown in FIG. 8, compared to the case of applying only the porous sound-absorbing base material, it is recognized that normal incidence sound-absorbing characteristics of the sound-absorbing panel of the example 2 is increased to some degree. The cause of this result is inferred that, compared to the case of applying only the porous sound-absorbing base material, the value of the airflow resistance is increased to some degree by combining the porous sound-absorbing base material and the porous veneer, and therefore, the sound-absorbing characteristics are improved as in the first example.

Example 3

A porous veneer which has 30.9% aperture ratio is produced by forming pierced apertures of 70 μm diameter (0.07 mm) with 0.12 mm intervals between them by applying EB (Electron Beam) processing on a veneer which is a stainless veneer of 50 μm (0.05 mm) thickness prepared beforehand and on which a design is processed beforehand.

Next, as the porous sound-absorbing base material, an aluminum sheet of 1 mm thickness (product name: Altone, produced by NICHIAS Corporation) was prepared and the panel main body was formed by adhering this porous sound-absorbing base material to the porous veneer. The value of the airflow resistance of the panel main body was 0.2 Pa. The sound-absorbing panel of the example 3 is produced in such manner.

Figure 9:
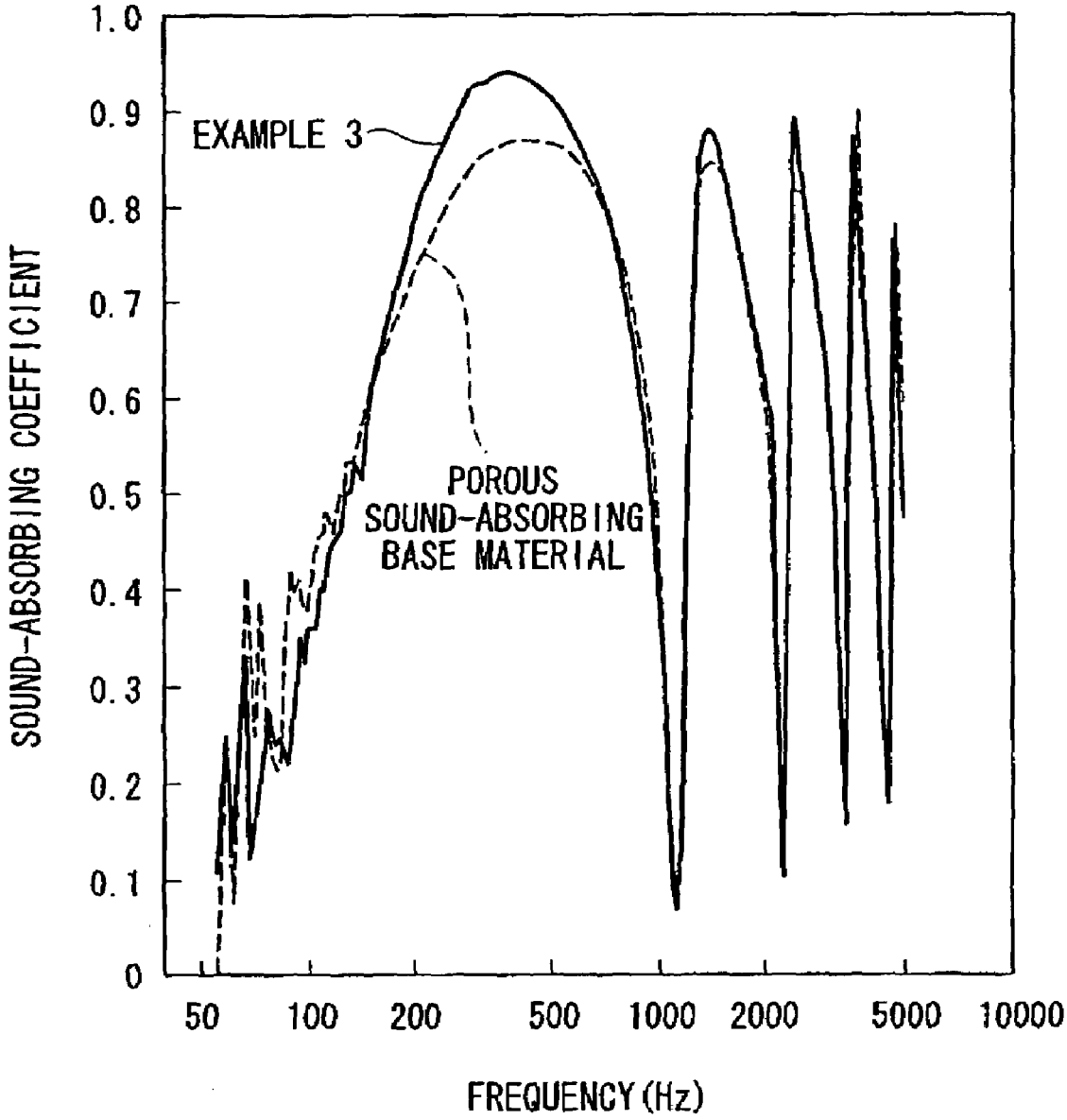
FIG. 9 is a graph showing the frequency dependency of normal incidence sound-absorbing characteristics of a third embodiment.

With respect to the sound-absorbing panel of the example 3, normal incidence sound-absorbing characteristics are measured in the case of setting the thickness of the backside air layer to be 150 mm. FIG; 9 shows the results. FIG. 9 shows normal incidence sound-absorbing characteristics measured in the case of applying only the porous sound-absorbing base material of 1 mm thickness (product name: Altone (registered trademark), produced by NICHIAS Corporation) as well.

Same as in the examples 1 and 2, compared to the case of applying only the porous sound-absorbing base material, it is recognized that normal incidence sound-absorbing characteristics of the sound-absorbing panel of the example 3 is increased to some degree. The cause of this result is inferred that, compared to the case of applying only the porous sound-absorbing base material, the value of the airflow resistance is increased to some degree by combining the porous sound-absorbing base material and the porous veneer, and therefore, the sound-absorbing characteristics are improved as in the examples 1 and 2.

Example 4

A porous veneer which has 0.9% aperture ratio is produced by forming pierced apertures of 70 μm diameter (0.07 mm) with 0.7 mm intervals between them by applying laser processing on a veneer which is a PET film of 50 μm (0.05 mm) thickness prepared beforehand and on which designing is processed beforehand. Next, as the porous sound-absorbing base material, a ceramic particle sintered material of 20 mm thickness (product name: cerathone (registered trademark) produced by NGK INSULATORS LTD.) was prepared and the panel main body was formed by adhering this porous sound-absorbing base material to the porous veneer. The value of the airflow resistance of the panel main body was 0.5 Pa. The sound-absorbing panel of the example 4 is produced in such a manner.

Figure 10:
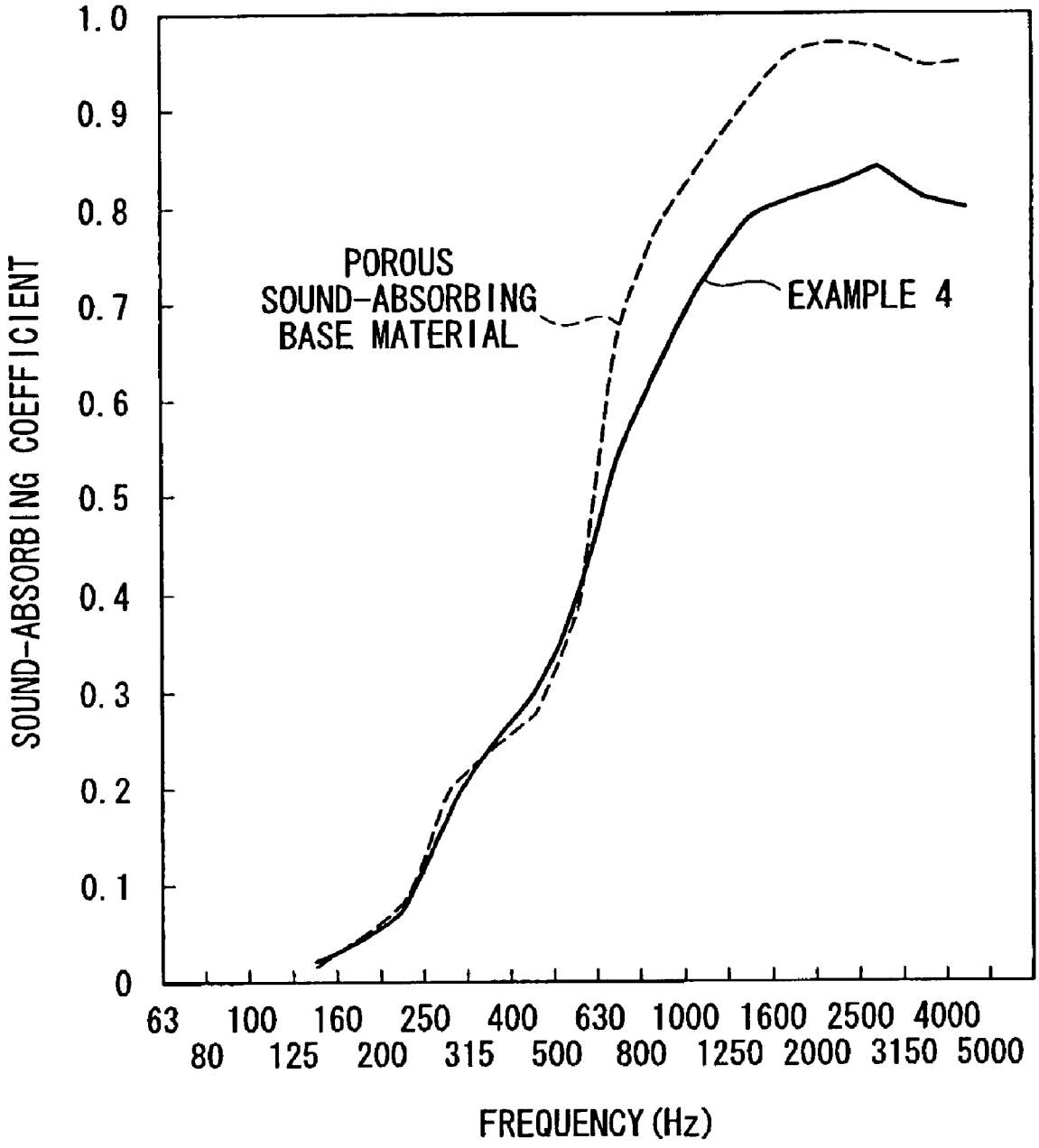
FIG. 10 is a graph showing the frequency dependency of normal incidence sound-absorbing characteristics of a fourth embodiment.

With respect to the sound-absorbing panel of the example 4, normal incidence sound-absorbing characteristics are measured in the case of setting the thickness of the backside air layer to be 20 mm. FIG. 10 shows the results. FIG. 10 shows normal incidence sound-absorbing characteristics measured in the case of applying only the porous sound-absorbing base material (product name: cerathone (registered trademark) produced by NGK INSULATORS LTD.) as well.

Compared to the case of applying only the porous sound-absorbing base material, it is recognized that normal incidence sound-absorbing characteristics of the sound-absorbing panel of the example 4 is reduced to some degree. Different from examples 1-3, the cause of this result is inferred that, compared to the case of applying only the porous sound-absorbing base material, the value of the airflow resistance is increased to some degree by combining the porous sound-absorbing base material and the porous veneer, and therefore, the sound-absorbing characteristics are reduced.

Examples 5/6 and Comparative Example 1

Three kinds of porous veneers which have 35.4-1.0% aperture ratios are produced by forming pierced apertures of 75 μm diameter (0.075 mm) with 0.12-0.70 mm intervals between them by applying EB (Electron Beam) processing on a veneer which is a stainless veneer of 50 μm (0.05 mm) thickness prepared beforehand and on which design is processed beforehand.

Next, honeycomb constitution materials (product name: paper honeycomb, produced by Showa Aircraft Industry Co., Ltd) of 10 mm thickness which have cell size of 19 mm are prepared, and three kinds of panel main bodies are formed by adhering the supporting materials to the respective porous veneers. The value of the airflow resistance of the panel main body was 0.01-0.30 Pa. The sound-absorbing panels of the examples 5, 6 and the comparative example 1 are produced in a such manner.

Figure 11:
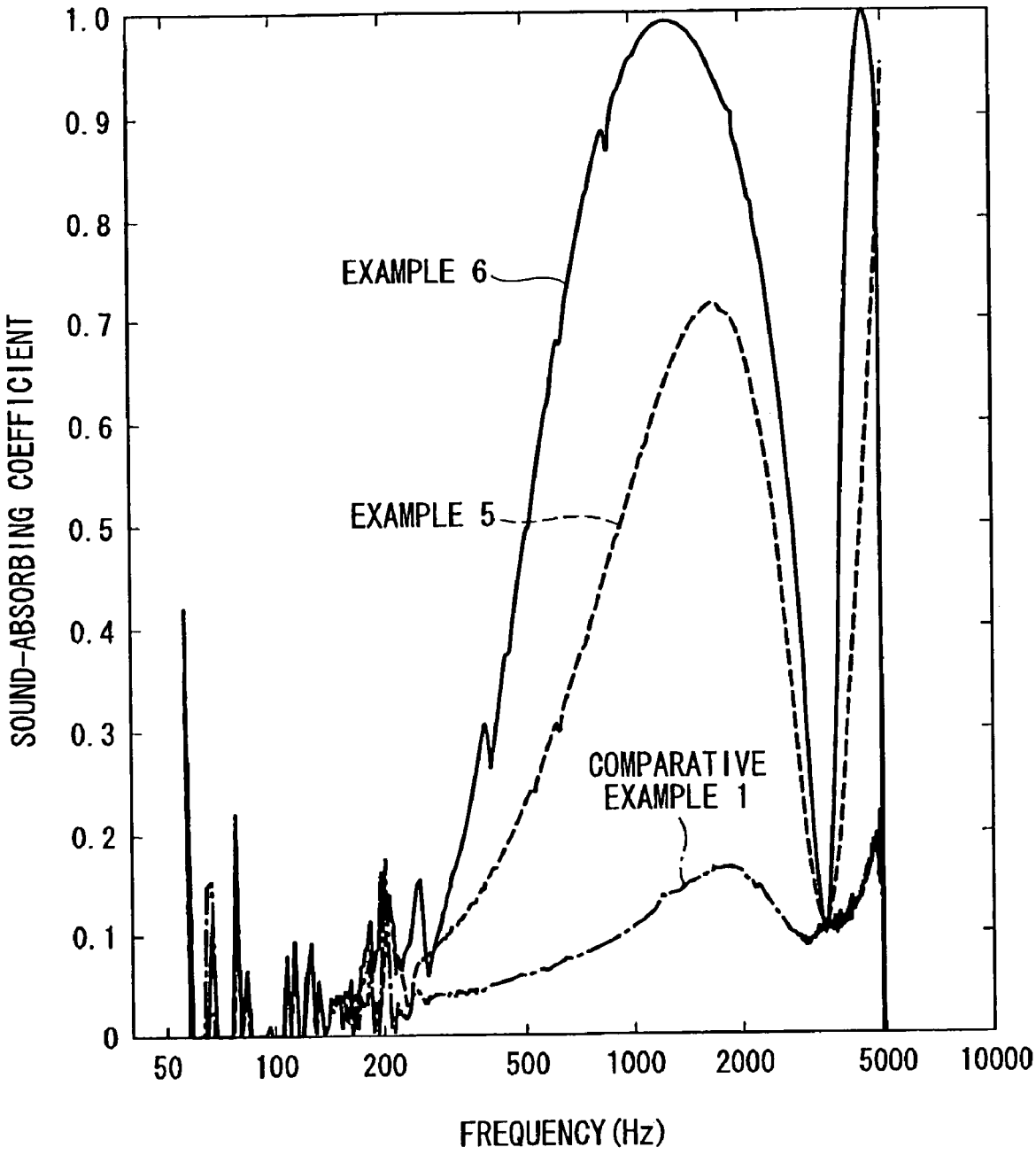
FIG. 11 is a graph showing the frequency dependency of normal incidence sound-absorbing characteristics of fifth and sixth embodiments and a first comparative example.

With respect to the sound-absorbing panels of the examples 5, 6 and the comparative example 1, normal incidence sound-absorbing characteristics are measured in the case of setting the thickness of the backside air layers to be 40 mm. FIG. 11 shows the results. Moreover, a table 2 shows both the constitutions of the sound-absorbing panels and the maximum sound-absorbing coefficients.

As shown in FIG. 11 and the table 2, it is observed that the normal incidence sound-absorbing characteristics of the sound absorbing panels of the examples 5 and 6 are greatly improved over the comparative example 1. In the comparative example 1, the aperture ratio of the porous veneer is 35.4% and is comparatively high. Therefore, the value of the airflow resistance is decreased to be 0.01 Pa, and therefore, compared to the examples 5 and 6, the sound-absorbing characteristics are reduced.

TABLE 2

| | POROUS VENEER | | | | | PANEL | |
|---|---|---|---|---|---|---|---|
| | MATERIAL | THICKNESS (μM) | APERTURE DIAMETER OF PIERCED APERTURE (μM) | INTERVALS BETWEEN PIERCED APERTURES (MM) | APERTURE RATIO (%) | VALUE OF RESISTANCE OF AIRFLOW (PA) | MAXIMUM SOUND-ABSORBING COEFFICIENT (%) |
| COMPARATIVE EXAMPLE 1 | SUS | 50 | 75 | 0.12 | 35.4 | 0.01 | 17 |
| EXAMPLE 5 | SUS | 50 | 75 | 0.35 | 4.2 | 0.13 | 72 |
| EXAMPLE 6 | SUS | 50 | 75 | 0.7 | 1 | 0.3 | 99 |

On the other hand, with respect to the sound-absorbing panels of the above-described examples 5-6 and the comparative example 1, instead of the honeycomb structure materials, in a case of supporting the backside of the porous veneers by applying punching metals of 0.5 mm thickness made from stainless steel which have an aperture ratio of 80% and which have the apertures in approximately lozenge shapes (lengths of diagonal lines are 7 mm and 3 mm), the sound-absorbing characteristics are measured under a condition of applying the backside air layer of 50 mm, and the similar results as the table 2 and the FIG. 11 are obtained.

Example 7

Veneers made from paper or stainless steel of 20 μm (0.02 mm) to 500 μm (0.5 mm) thickness on which design is processed beforehand are prepared, and seventeen kinds of porous veneers which have 69.4-0.2% aperture ratios produced by forming pierced apertures of 75 μm (0.075 mm) to 100 μm (0.1 mm) diameter by applying laser processing on the paper veneer and by applying EB (Electron Beam) processing on the stainless veneer. Next, honeycomb constitution materials (product name: paper honeycomb, produced by Showa Aircraft Industry Co., Ltd) of 10 mm thickness which have cell sizes of 19 mm are prepared, and seventeen kinds of panel main bodies are formed by adhering the supporting materials to the respective porous veneers. The value of the airflow resistance of the panel main body was 0.01-1.5 Pa. The sound-absorbing panels of the samples No. 26-42 were produced in such a manner.

Figure 12:
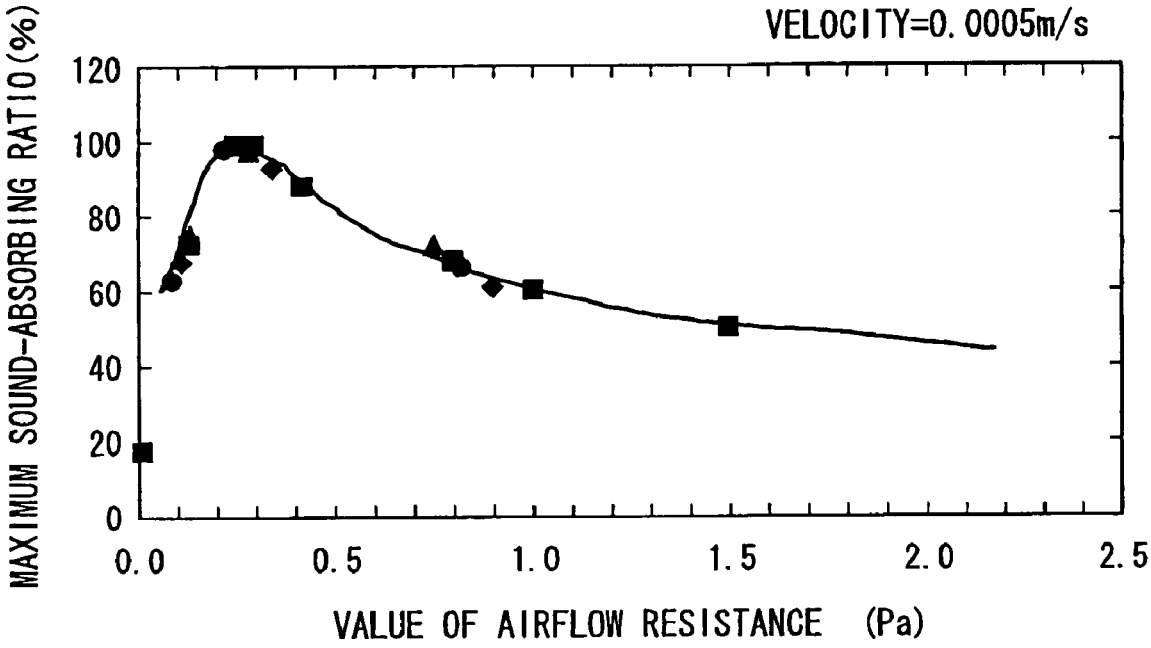
FIG. 12 is a graph showing a relationship between maximum sound-absorbing coefficients and the values of the airflow resistance based on measured results of normal incidence sound-absorbing characteristics of the sound-absorbing panels of samples No. 26-42.

With respect to the sound-absorbing panels of the samples No. 26-42, normal incidence sound-absorbing characteristics are measured in the case of setting the thickness of the backside air layers to be 40 mm in order to measure the maximum sound-absorbing coefficients. FIG. 12 is a graph showing a relationship between maximum sound-absorbing coefficients and the values of the airflow resistance based on measured results of normal incidence sound-absorbing characteristics of the sound-absorbing panels of samples No. 26-42. Moreover, a table 3 shows both the constitutions of the sound-absorbing panels and the maximum sound-absorbing coefficients.

TABLE 3

| | POROUS VENEER | | | | PANEL | |
|---|---|---|---|---|---|---|
| SAMPLE NO. | MATERIAL | THICKNESS (μM) | APERTURE DIAMETER OF PIERCED APERTURE (μM) | APERTURE RATIO (%) | VALUE OF RESISTANCE OF AIRFLOW (PA) | MAXIMUM SOUND-ABSORBING COEFFICIENT (%) |
| 26 | SUS | 50 | 75 | 35.4 | 0.01 | 17 |
| 27 | SUS | 50 | 75 | 4.2 | 0.13 | 72 |
| 28 | PAPER | 50 | 100 | 1.8 | 0.25 | 99 |
| 29 | SUS | 50 | 75 | 1 | 0.3 | 99 |
| 30 | PAPER | 50 | 75 | 0.6 | 0.42 | 88 |
| 31 | SUS | 50 | 75 | 0.4 | 0.8 | 68 |
| 32 | SUS | 50 | 75 | 0.3 | 1 | 60 |
| 33 | SUS | 50 | 75 | 0.2 | 1.5 | 50 |
| 34 | SUS | 20 | 75 | 2.8 | 0.11 | 68 |
| 35 | SUS | 20 | 75 | 0.9 | 0.34 | 93 |
| 36 | SUS | 20 | 75 | 0.2 | 0.9 | 61 |
| 37 | SUS | 100 | 75 | 13.7 | 0.13 | 75 |
| 38 | SUS | 100 | 75 | 2.8 | 0.28 | 98 |
| 39 | SUS | 100 | 75 | 0.9 | 0.75 | 72 |
| 40 | SUS | 500 | 75 | 69.4 | 0.09 | 63 |
| 41 | SUS | 500 | 75 | 11.1 | 0.22 | 98 |
| 42 | SUS | 500 | 75 | 4.1 | 0.82 | 66 |

As shown in the table 3 and FIG. 12, in the cases of constituting the sound-absorbing panels by arranging the porous veneers and the supporting base materials so as to be overlapped, if the value of the airflow resistance is in the range of 0.1-1.0 Pa, it is possible to achieve a 60% or larger maximum sound-absorbing coefficient, moreover, if the value of the airflow resistance is in the range of 0.15-0.5 Pa, the sound-absorbing coefficient can be 80% or larger, and furthermore, if the value of the airflow resistance is in the range of 0.2-0.45 Pa, the sound-absorbing coefficient can be 90% or larger.

Example 8

A porous veneers which have 0.91-10% aperture ratio were produced by forming multiple pierced apertures of 50-200 μm diameter (0.05-0.2 mm) at regular intervals among them by applying EB (Electron Beam) processing on the veneers which are stainless veneers of 50-100 μm (0.05-0.1 mm) thickness prepared beforehand and on which design were processed beforehand.

Next, as the porous sound-absorbing base materials, a glass wool of 50 mm thickness (product name: glass wool 32K, produced by ASAHI FIBER GLASS Co., Ltd) and an aluminum sheet of 1 mm thickness (product name: Altone, produced by NICHIAS Corporation) were prepared, and six kinds of panel main bodies were formed by adhering each of the porous sound-absorbing base materials to the porous veneers. The values of resistance of airflow of the panel main bodies were 0.29-0.35 Pa. The sound-absorbing panels of the samples No. 43-48 were produced in such a manner.

Figure 13:
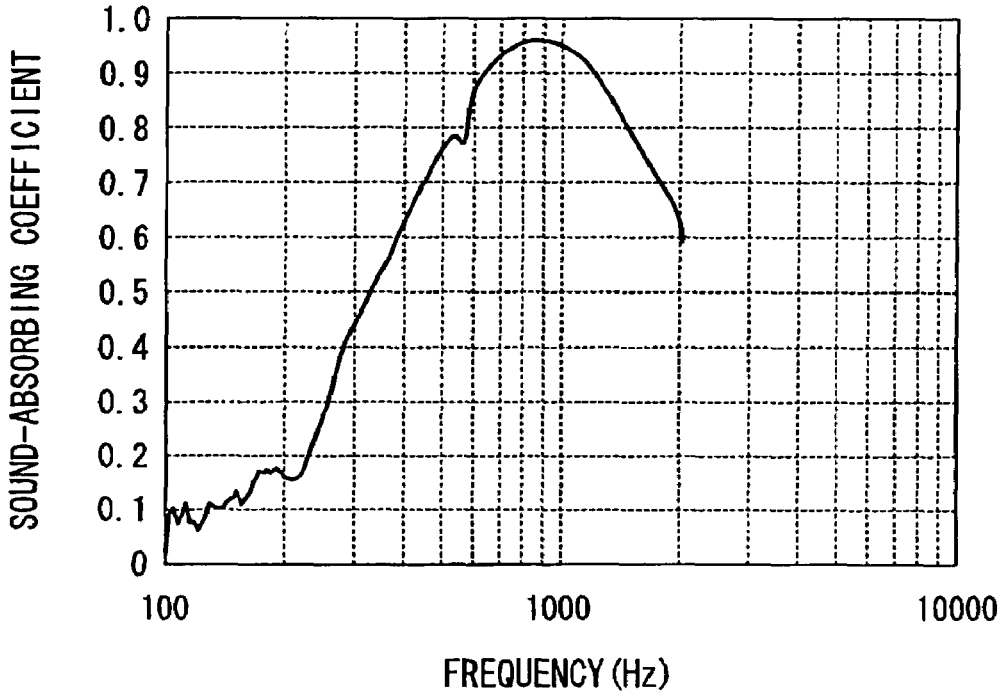
FIG. 13 is a graph showing the frequency dependency of normal incidence sound-absorbing characteristics of a sample No. 44 of an eighth embodiment.

With respect to the sound-absorbing panels of the samples No. 43-48, normal incidence sound-absorbing characteristics were measured in the case of setting the thickness of the backside air layers to be 50 mm in order to measure the maximum sound-absorbing coefficients. A table 4 shows both the constitutions of the sound-absorbing panels and the maximum sound-absorbing coefficients. FIG. 13 shows measured results of the normal incidence sound-absorbing characteristics of the sound-absorbing panel of the sample No. 44.

TABLE 4

| | POROUS VENEER | | | | POROUS SOUND-ABSORBING BASE MATERIAL | | | PANEL | |
|---|---|---|---|---|---|---|---|---|---|
| SAMPLE NO. | MATERIAL | THICKNESS (μM) | APERTURE DIAMETER OF PIERCED APERTURE (μM) | APERTURE RATIO (%) | MATERIAL | THICKNESS (μM) | VALUE OF RESISTANCE OF AIRFLOW (PA) | VALUE OF RESISTANCE OF AIRFLOW (PA) | MAXIMUM SOUND-ABSORBING COEFFICIENT (%) |
| 43 | SUS | 100 | 150 | 2.04 | GW32K | 50 | 0.26 | 0.3 | 99 |
| 44 | SUS | 100 | 200 | 0.91 | GW32K | 50 | 0.26 | 0.32 | 97 |
| 45 | SUS | 100 | 150 | 2.04 | ALTONE | 1 | 0.16 | 0.3 | 98 |
| 46 | SUS | 100 | 200 | 0.91 | ALTONE | 1 | 0.16 | 0.35 | 92 |
| 47 | SUS | 50 | 50 | 10 | GW32K | 50 | 0.26 | 0.29 | 98 |
| 48 | SUS | 50 | 50 | 10 | ALTONE | 1 | 0.16 | 0.29 | 98 |

As shown in the table 4 and FIG. 13, in the cases of applying the porous veneers which have the aperture diameters of 50-200 μm, if the values of resistance of airflow of the panel main bodies are in the range of 0.1-1.0 Pa, it is possible to obtain excellent maximum sound-absorbing coefficients.

Example 9

Porous veneers which have 0.91-10.0% aperture ratio were produced by forming multiple pierced apertures of 50-200 μm diameter (0.05-0.2 mm) at regular intervals among them by processing etching on the veneers which are stainless veneers of 50 μm (0.05 mm)-100 μm (0.1 mm) thickness prepared beforehand and on which design were processed beforehand.

Next, as the supporting base materials 3, punching metals of 0.5 mm thickness made from stainless steel which have an aperture ratio of 80% and which have the apertures of 7 mm×3 mm aperture diameters in approximately lozenge shapes were prepared, and three kinds of the panel main bodies were formed by adhering these supporting base materials to each of the above-described porous veneers. The values of resistance of airflow of the panel main bodies were 0.12-0.14 Pa. The sound-absorbing panels of the samples No. 49-51 were produced in such a manner.

Figure 14:
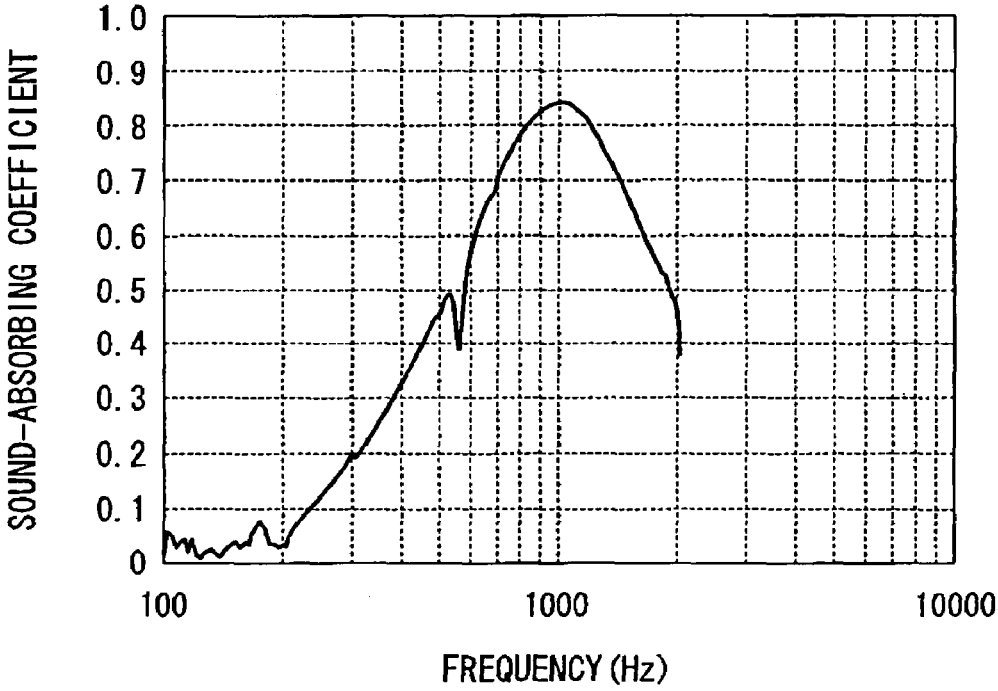
FIG. 14 is a graph showing the frequency dependency of normal incidence sound-absorbing characteristics of a sample No. 50 of a ninth embodiment.

With respect to the sound-absorbing panels of the samples No. 49-51, normal incidence sound-absorbing characteristics were measured in the case of setting the thickness of the backside air layers to be 50 mm in order to measure the maximum sound-absorbing coefficients. A table 5 shows both the constitutions of the sound-absorbing panels and the maximum sound-absorbing coefficients. FIG. 14 shows measured results of the normal incidence sound-absorbing characteristics of the sound-absorbing panel of the sample No. 50.

TABLE 5

| | POROUS VENEER | | | | PANEL | |
|---|---|---|---|---|---|---|
| SAMPLE NO. | MATERIAL | THICKNESS (μM) | APERTURE DIAMETER OF PIERCED APERTURE (μM) | APERTURE RATIO (%) | VALUE OF RESISTANCE OF AIRFLOW (PA) | MAXIMUM SOUND-ABSORBING COEFFICIENT (%) |
| 49 | SUS | 100 | 150 | 2.04 | 0.12 | 76 |
| 50 | SUS | 100 | 200 | 0.91 | 0.14 | 86 |
| 51 | SUS | 50 | 50 | 10 | 0.13 | 71 |

As shown in the table 5 and FIG. 14, in the cases of applying the punching metals as the supporting materials, if the values of resistance of airflow of the panel main bodies are in the range of 0.1-1.0 Pa, it is possible to obtain 60% or more maximum sound-absorbing coefficient of the sound-absorbing panel.

Example 10

Porous veneers which have 2.78% aperture ratio were produced by forming multiple pierced apertures of 75 μm diameter (0.075 mm) at regular intervals among them by processing etching on the veneers which are stainless steel, copper and invar alloy veneers of 100 μm (0.1 mm) thickness prepared beforehand and on which design were processed beforehand.

Next, as the porous sound-absorbing base materials, glass wools of 50 mm thickness (product name: glass wool 32K, produced by ASAHI FIBER GLASS Co., lid) were prepared, and three kinds of panel main bodies were formed by respectively adhering porous sound-absorbing base materials to the porous veneers. The values of resistance of airflow of the panel main bodies were 0.44-0.46 Pa. The sound-absorbing panels of the samples No. 52-54 were produced in such a manner.

With respect to the sound-absorbing panels of the samples No. 52-54, normal incidence sound-absorbing characteristics were measured in the case of setting the thickness of the backside air layers to be 50 mm in order to measure the maximum sound-absorbing coefficients. A table 6 shows both the constitutions of the sound-absorbing panels and the maximum sound-absorbing coefficients.

TABLE 6

| | POROUS VENEER | | | | POROUS SOUND-ABSORBING BASE MATERIAL | | | PANEL | |
|---|---|---|---|---|---|---|---|---|---|
| SAMPLE NO. | MATERIAL | THICKNESS (μM) | APERTURE DIAMETER OF PIERCED APERTURE (μM) | APERTURE RATIO (%) | MATERIAL | THICKNESS (μM) | VALUE OF RESISTANCE OF AIRFLOW (PA) | VALUE OF RESISTANCE OF AIRFLOW (PA) | MAXIMUM SOUND-ABSORBING COEFFICIENT (%) |
| 52 | ALMINIUM | 100 | 75 | 2.78 | GW32K | 50 | 0.26 | 0.46 | 92 |
| 53 | COPPER | 100 | 75 | 2.78 | GW32K | 50 | 0.26 | 0.45 | 94 |
| 54 | INVAR | 100 | 75 | 2.78 | GW32K | 50 | 0.26 | 0.44 | 91 |

As shown in the table 6, in the cases of applying aluminum, copper or invar as the material of the porous veneers, if the values of resistance of airflow of the panel main bodies are in the range of 0.1-1.0 Pa, it is possible to obtain 60% or more maximum sound-absorbing coefficient of the sound-absorbing panel.

Example 11

Porous veneers which have 0.91-13.7% aperture ratio were produced by forming multiple pierced apertures of 75 μm diameter (0.075 mm) at regular intervals among them by applying EB (Electron Beam) processing on the veneers which are stainless steel, copper and invar alloy veneers of 100 μm (0.1 mm) thickness prepared beforehand and on which designing were processed beforehand.

Next, as the supporting base materials, punching metals of 0.5 mm thickness made from stainless steel which have an aperture ratio of 80% and which have the apertures of 7 mm×3 mm aperture diameters in approximately lozenge shapes were prepared, and five kinds of the panel main bodies were formed by adhering these supporting base materials to each of the above-described porous veneers. The values of resistance of airflow of the panel main bodies were 0.12-0.61 Pa The sound-absorbing panels of the samples No. 55-59 were produced in such a manner.

With respect to the sound-absorbing panels of the samples No. 55-59, normal incidence sound-absorbing characteristics were measured in the case of setting the thickness of the backside air layers to be 50 mm in order to measure the maximum sound-absorbing coefficients. A table 7 shows both the constitutions of the sound-absorbing panels and the maximum sound-absorbing coefficients.

TABLE 7

| | POROUS VENEER | | | | PANEL | |
|---|---|---|---|---|---|---|
| SAMPLE NO. | MATERIAL | THICKNESS (μM) | APERTURE DIAMETER OF PIERCED APERTURE (μM) | APERTURE RATIO (%) | VALUE OF RESISTANCE OF AIRFLOW (PA) | MAXIMUM SOUND-ABSORBING COEFFICIENT (%) |
| 55 | ALUMINIUM | 100 | 75 | 13.7 | 0.12 | 73 |
| 56 | ALUMINIUM | 100 | 75 | 2.78 | 0.24 | 99 |
| 57 | ALUMINIUM | 100 | 75 | 0.91 | 0.61 | 76 |
| 58 | COPPER | 100 | 75 | 2.78 | 0.25 | 98 |
| 59 | INVAR | 100 | 75 | 2.78 | 0.24 | 97 |

As shown in the table 7, in the cases of applying aluminum, copper or invar as the material of the porous veneers and applying the punching metals as the supporting base materials, if the values of resistance of airflow of the panel main bodies are in the range of 0.1-1.0 Pa, it is possible to obtain 60% or more maximum sound-absorbing coefficient of the sound-absorbing panel.

In accordance with the present invention, it is possible to provide a sound-absorbing panel and a production method of the same which have excellent freedom of design and have less difference in the maximum sound-absorbing coefficients among the products.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A sound-absorbing panel comprising a panel main body, wherein the panel main body comprises:

a porous veneer of 0.02-0.5 mm thickness which comprises pierced apertures of 0.2 mm or smaller aperture diameters and which has an aperture ratio of 0.2-3.6%; and a porous sound-absorbing base material arranged at a backside of the porous veneer;

wherein the panel main body is provided by arranging the porous veneer and the porous sound-absorbing base material to be overlapped; and a value of airflow resistance of the panel main body is in a range of 0.1-1.0 Pa.

2. The sound-absorbing panel according to claim 1, wherein a value of airflow resistance of the porous sound-absorbing base material is in a range of 0.1-0.8 Pa.

3. A sound-absorbing panel comprising a panel main body, wherein the panel main body comprises:

a porous veneer of 0.02-0.5 rum thickness which comprises pierced apertures of 0.2 mm or smaller aperture diameters; and a supporting base material arranged at a backside of the porous veneer;

wherein the panel main body is provided by arranging the porous veneer and the supporting base material to be overlapped; and a value of airflow resistance of the panel main body is in a range of 0.1-1.0 Pa;

wherein the supporting base material is a honeycomb structure material, a punched metal or an expanded metal.

4. The sound-absorbing panel according to claim 1, wherein both the porous veneer and the porous sound-absorbing base material are detachably attached.

5. The sound-absorbing panel according to claim 3, wherein both the porous veneer and the supporting base material are detachably attached.

6. A production method of a sound-absorbing panel comprising the steps of:

forming a porous veneer which has an aperture ratio of 0.2-3.6% by forming a plurality of pierced apertures of 0.2 mm or smaller aperture diameters on a veneer of 0.02-0.5 mm thickness; and providing a panel main body by arranging a porous sound-absorbing base material at a backside of the porous veneer to be overlapped, along with setting a value of airflow resistance of the panel main body in a range of 0.1-1.0 Pa.

7. The production method of a sound-absorbing panel according to claim 6, wherein a design is applied to a surface of the porous veneer opposite to the backside.

8. A production method of a sound-absorbing panel comprising the steps of:

forming a porous veneer which has an aperture ratio of 0.2-3.6% by forming a plurality of pierced apertures of 0.2 mm or smaller aperture diameters on a veneer of 0.02-0.5 mm thickness; and forming a supporting base material which is a honeycomb structure material, a punched metal or an expanded metal;

providing a panel main body which comprises both the porous veneer and the supporting base material, by arranging the supporting base material at a backside of the porous veneer to be overlapped, along with setting a value of airflow resistance of the panel main body in a range of 0.1-1.0 Pa.

* * * * *